US009243497B2

(12) United States Patent
Jones et al.

(10) Patent No.: US 9,243,497 B2
(45) Date of Patent: Jan. 26, 2016

(54) SYSTEM FOR SEAFLOOR MINING

(75) Inventors: Glen Robert Jones, Milton (AU); Antony Eliot Inglis, Milton (AU); Anthony Paul O'Sullivan, Milton (AU); Michael Howitt, Milton (AU); Glen Smith, Milton (AU); Roland Gunter Berndt, Milton (AU); Daal Hallam Jaffers, Milton (AU)

(73) Assignee: Nautilus Minerals Pacific Pty Ltd, Milton (AU)

( * ) Notice: Subject to any disclaimer, the term of this patent is extended or adjusted under 35 U.S.C. 154(b) by 97 days.

(21) Appl. No.: 13/805,216

(22) PCT Filed: Jun. 17, 2011

(86) PCT No.: PCT/AU2011/000733

§ 371 (c)(1), (2), (4) Date: Aug. 1, 2013

(87) PCT Pub. No.: WO2011/156867

PCT Pub. Date: Dec. 22, 2011

(65) Prior Publication Data

US 2013/0312296 A1 Nov. 28, 2013

(30) Foreign Application Priority Data

Jun. 18, 2010 (AU) ..... 2010902665

(51) Int. Cl.
*E02F 5/00* (2006.01)
*E21C 50/00* (2006.01)
(Continued)

(52) U.S. Cl.
CPC ..... *E21C 50/00* (2013.01); *B63C 11/52* (2013.01); *E02F 3/8866* (2013.01); *E02F 3/905* (2013.01); *E02F 7/005* (2013.01); *E02F 7/06* (2013.01); *E21C 45/00* (2013.01)

(58) Field of Classification Search
CPC ..... E02F 3/04; E02F 3/90; E02F 3/905; E02F 3/8858; E02F 3/8866; E02F 5/006; E02F 7/005; E02F 7/06; E21C 45/00; E21C 50/00
USPC ..... 37/195, 311, 314, 317, 318, 321, 322, 37/345, 307, 326, 327, 337, 338, 342, 343, 37/366, 367; 209/355; 299/8, 9, 7, 73; 417/78, 84, 174, 178, 183; 405/158, 405/159, 161, 163, 166, 174, 179, 191
See application file for complete search history.

(56) References Cited

U.S. PATENT DOCUMENTS

| | | | | | |
|---|---|---|---|---|---|
| 3,010,232 | A | * | 11/1961 | Skakel et al. | 37/195 |
| 3,731,975 | A | | 5/1973 | Lindelof | |
| 3,971,593 | A | * | 7/1976 | Porte et al. | 299/8 |
| 4,010,560 | A | | 3/1977 | Diggs | |
| 4,195,426 | A | * | 4/1980 | Banzoli et al. | 37/309 |
| 4,311,342 | A | * | 1/1982 | Latimer | 299/8 |

(Continued)

FOREIGN PATENT DOCUMENTS

| | | | |
|---|---|---|---|
| DE | 19715284 | A1 | 10/1998 |
| JP | 2004137806 | A | 5/2004 |
| JP | 2009280960 | A | 12/2009 |

OTHER PUBLICATIONS

International Search Report for PCT/AU2011/000733.

*Primary Examiner* — Robert Pezzuto
(74) *Attorney, Agent, or Firm* — McDonnell Boehnen Hulbert & Berghoff LLP

(57) ABSTRACT

A system for seafloor mining. A seafloor auxiliary mining tool works a seafloor site to prepare a bench, and deposits cut ore in a gathering area. A seafloor bulk mining tool undertakes production cutting of a bench and deposits cut ore in a gathering area. A seafloor gathering machine gathers cut ore deposited in the gathering area and pumps gathered ore as a slurry to a riser base. A riser and lifting system receives slurry from the gathering machine and lifts the slurry to the surface. A surface vessel receives slurry from the riser and lifting system.

26 Claims, 10 Drawing Sheets

(51) Int. Cl.

| | |
|---|---|
| ***B63C 11/52*** | (2006.01) |
| ***E02F 3/88*** | (2006.01) |
| ***E02F 3/90*** | (2006.01) |
| ***E02F 7/00*** | (2006.01) |
| ***E02F 7/06*** | (2006.01) |
| ***E21C 45/00*** | (2006.01) |

(56) References Cited

U.S. PATENT DOCUMENTS

| | | | | |
|---|---|---|---|---|
| 5,150,986 | A * | 9/1992 | Rohr | 405/223 |
| 8,794,710 | B2 * | 8/2014 | Howard et al. | 299/9 |

* cited by examiner

| Time Period | Seafloor Site 1 | Seafloor Site 2 |
|---|---|---|
| 1 | GM removes unconsolidated sediment | |
| 2 | Inter-site SMT movement | |
| 3 | AUX cuts down obstructions to prepare landing area for BM and GM and levels terrain to prepare a bench | GM removes unconsolidated sediment |
| 4 | Inter-site SMT movement | |
| 5 | GM gathers cut ore left by AUX | AUX cuts down obstructions to prepare landing area for BM and GM and levels terrain to prepare a bench |
| 6 | Inter-site SMT movement | |
| 7 | BM cuts bench to depth of 0.5 – 1m in multiple passes, leaving remnant edges | GM gathers cut ore left by AUX |
| 8 | Inter-site SMT movement | |
| 9 | GM gathers cuttings of cut bench left by BM | BM cuts bench to depth of 0.5 – 1m in multiple passes, leaving remnant edges |
| 10 | Inter-site SMT movement | |
| 11 | BM cuts bench to depth of 0.5 – 1m in multiple passes, leaving remnant edges | GM gathers cuttings of cut bench left by BM |
| 12 | (... multiple benches cut and cleared until remnant edges > 4m high ... ) | |
| 13 | AUX cuts away remnant edges of removed benches to present new levelled bench | GM gathers cuttings of cut bench left by BM |
| 14 | Inter-site SMT movement | |
| 15 | GM gathers cut ore left by AUX | AUX cuts away remnant edges of removed benches to present new levelled bench |
| 16 | Inter-site SMT movement | |
| 17 | BM cuts bench to depth of 0.5 – 1m in multiple passes, leaving remnant edges | GM gathers cut ore left by AUX |
| 18 | ( ... continue until site mining complete ... ) | |

Figure 3

SYSTEM FOR SEAFLOOR MINING

This application is a U.S. National Phase Application pursuant to 35 U.S.C. §371 of International Application No. PCT/AU2011/000733 filed on Jun. 17, 2011, which claims priority to Australian patent application 2010902665, filed Jun. 18, 2010, the disclosures of which are incorporated herein by reference in their entirety.

TECHNICAL FIELD

The present invention relates generally to underwater mining, and in particular relates to a system and method for seafloor mining and gathering comprising a plurality of cooperating seafloor tools.

BACKGROUND OF THE INVENTION

Seabed excavation is often performed by dredging, for example to retrieve valuable alluvial placer deposits or to keep waterways navigable. Suction dredging involves positioning a gathering end of a pipe or tube close to the seabed material to be excavated, and using a surface pump to generate a negative differential pressure to suck water and nearby mobile seafloor sediment up the pipe. Cutter suction dredging further provides a cutter head at or near the suction inlet to release compacted soils, gravels or even hard rock, to be sucked up the tube. Large cutter suction dredges can apply tens of thousands of kilowatts of cutting power. Other seabed dredging techniques include auger suction, jet lift, air lift and bucket dredging.

Most dredging equipment typically operates only to depths of tens of meters, with even very large dredges having maximum dredging depths of little more than one hundred meters. Dredging is thus usually limited to relatively shallow water.

Subsea boreholes such as oil wells can operate in deeper water of up to several thousand meters depth. However, subsea borehole mining technology does not enable seafloor mining.

Any discussion of documents, acts, materials, devices, articles or the like included in the present specification is for the purpose of providing a context for the present invention, and is not to be taken as an admission that any such matters form part of the prior art base or were before the priority date of each claim of this application common general knowledge in the field relevant to the present invention.

In this document the term "comprise", and derivatives including "comprises", "comprised" or "comprising", are to be understood to convey inclusion of one or more stated elements, integers or steps, but not the exclusion of any other element, integer or step.

SUMMARY OF THE INVENTION

According to a first broad aspect the present invention provides a system for seafloor mining, the system comprising:

- a seafloor auxiliary mining tool for working a seafloor site to prepare a bench, and for depositing cut ore in a gathering area;
- a seafloor bulk mining tool for production cutting of a bench and deposition of cut ore in a gathering area;
- a seafloor gathering machine for gathering cut ore deposited in the gathering area and pumping gathered ore as a slurry to a riser base;

- a riser and lifting system for receiving slurry from the gathering machine and lifting the slurry to the surface; and
- a surface vessel for receiving slurry from the riser and lifting system.

According to a second aspect the present invention provides a method for seafloor mining, the method comprising:

- preparing a bench of a seafloor site using a seafloor auxiliary mining tool and depositing cut ore in a gathering area;
- bulk mining the bench with a seafloor bulk mining tool and depositing cut ore in a gathering area;
- gathering cut ore from the gathering area using a seafloor gathering machine, and pumping gathered ore as a slurry from the gathering machine to a riser base; and
- lifting the slurry to a surface vessel using a riser and lifting system.

The present invention recognises that seafloor sites of interest can be of complex topography, and the present invention thus provides for multiple seafloor mining tools operating in concert to effect retrieval of the seafloor material. The seafloor auxiliary mining tool is capable of traversing uneven ground and slopes, such capability preferably being up to at least 10 degrees, more preferably 20 degrees and even more preferably 25 degrees.

Further, the present invention provides a system adaptable in some embodiments to deployment at significant water depths. For example some embodiments may be operable at depths greater than about 400 m, more preferably greater than 1000 m and more preferably greater than 1500 m depth. Nevertheless it is to be appreciated that the multi-tool system of the present invention may also present a useful seafloor mining option in water as shallow as 100 m or other relatively shallow submerged applications. Accordingly is to be appreciated that references to the seafloor or seabed are not intended to exclude application of the present invention to mining or excavation of lake floors, estuary floors, fjord floors, sound floors, bay floors, harbour floors or the like, whether in salt, brackish, or fresh water, and such applications are included within the scope of the present specification.

Where the material to be retrieved is of a thickness greater than a bench height, the bench height being defined by the cutting depth of the seafloor bulk mining tool, multiple layers of benches of the material may be removed by sequential bulk mining and gathering steps. The seafloor auxiliary mining tool may be used to prepare and trim every bench layer, or may be employed to prepare and/or trim only some of the bench layers.

The seafloor gathering tool may be utilised to remove deposited sediment, such as mud, overlying a seafloor deposit of interest, prior to deployment of the seafloor auxiliary mining tool and seafloor bulk mining tool. It will be appreciated that in some applications where portions of the seafloor material of interest, such as ore, are sufficiently easy to mobilise, the gathering machine may be operated to directly recover such portions of the ore without the need for substantial cutting of such portions of the seafloor.

In embodiments of the invention deployed to seafloor sites of complex topography, the seafloor auxiliary mining tool is preferably employed to initiate site excavation. For example the seafloor auxiliary mining tool may prepare a landing area for the seafloor bulk mining tool, and may excavate extremities of the site in order to prepare a first bench ready for the seafloor bulk mining tool. The complex topography can include seafloors of varying strength and consistency, such as sands, silts, mud, rock and stockpiles of disaggregated ore.

After the seafloor bulk mining tool has cut one or more benches, and the gathering machine has gathered cuttings to clear the one or more benches, the seafloor auxiliary mining tool is preferably further employed to excavate remnant bench extremities or edge sections inaccessible to and/or bypassed by the seafloor bulk mining tool. Such embodiments recognise that a bulk mining tool is likely to lack mobility and accuracy in favour of bulk cutting capability, and thus a mining methodology is provided whereby the seafloor auxiliary mining tool is employed to trim such remnant sections.

The seafloor auxiliary mining tool preferably clears its own cuttings to a dump site to enable the seafloor auxiliary mining tool to progress through a formation as it works. For example the auxiliary mining tool may pump its cuttings in slurry form to a position lateral to the tool's path of travel. Where the seafloor auxiliary mining tool is cutting material of interest, such as ore, the cuttings of the seafloor auxiliary mining tool are preferably gathered by the seafloor gathering machine. Thus the gathering area in which cuttings from the auxiliary mining tool are deposited need not be the same as the gathering area in which cuttings from the bulk mining tool are deposited.

The seafloor auxiliary mining tool, seafloor bulk mining tool and seafloor gathering tool may each be an untethered remotely operated vehicle (ROV), or may be a tethered vehicle operated by umbilicals connecting to the surface.

During a time period in which the seafloor bulk mining tool works a bench, the seafloor auxiliary mining tool and seafloor gathering machine are preferably kept at a distance from that bench to avoid tool interference, and to avoid umbilical entanglement in the case of tethered vehicles. In preferred embodiments, during this time the seafloor auxiliary mining tool and/or seafloor gathering machine are preferably employed in their respective tasks on one or more separate benches within range nearby. Such embodiments provide for work on multiple bench sites to be progressed simultaneously, increasing tool utilisation and site productivity.

Each tool's buoyancy may preferably be selected and/or variably controlled in order that the tool has sufficient weight when submerged to apply the forces required for that tool's task. For example, the bulk mining tool may be configured to have the greatest negative buoyancy of the seafloor tools, in order that the bulk mining tool may apply sufficient downwards force to enable production cutting of a bench. The seafloor auxiliary mining tool is preferably configured to have adequate negative buoyancy to permit the auxiliary cutting tasks to be conducted by the seafloor auxiliary mining tool. The gathering tool may require relatively little negative buoyancy, for example merely requiring sufficient negative buoyancy to give traction for seafloor locomotion except and unless in a cutting mode. The gathering tool may for example have variable buoyancy to permit the gathering tool to become positively or neutrally buoyant so as to rise above the seafloor and navigate around the site using propellers or other thrusters, before settling at a new seafloor location under negative buoyancy. The seafloor auxiliary mining tool, and even the seafloor bulk mining tool, may also in some embodiments have variable buoyancy and suitable propulsion to permit similar such navigation above the seafloor.

The seafloor bulk mining tool is preferably designed to work on a relatively flat and relatively horizontal bench surface and to cut down into the surface to a cutting depth while traversing across the bench surface, leaving cuttings in place for subsequent gathering by the seafloor gathering tool. The seafloor bulk mining tool preferably cuts substantially an entire bench by traversing the surface of the bench in one or more paths. The cutting paths of the bulk mining tool are preferably optimised to maximise ore recovery from the bench based on the unique bench size and bench shape existing at the site concerned.

Preferably, the gathering area into which the cuttings are deposited by the bulk mining tool is the same location as the ore bench, whereby the bulk mining tool cuts the ore without substantially relocating the ore. Such embodiments permit the bulk mining tool design, function and operation to focus on the cutting requirements for such bulk mining, without being complicated by considerations of relocating cuttings. Alternatively the gathering area may be distal from the ore bench.

In an alternative embodiment of the system, the auxiliary miner and bulk miner are configured with slurry transfer pipes which are arranged to deliver cuttings from the respective tool in a slurry form to a stockpile site distal from the cutting location of the respective tool. In such embodiments, the gathering machine may work largely or only at the stockpile site, and deliver gathered ore to the base of the riser and lift system. Such embodiments may be advantageous in removing the dependence of the gathering machine productivity on the bulk miner and/or auxiliary miner productivity. That is, the gathering machine may continue to gather previously cut ore from the stockpile site even when the bulk miner and/or auxiliary miner are not cutting, and/or simultaneously with when the bulk miner and/or auxiliary miner are cutting.

The seafloor gathering tool preferably comprises a mobile slurry inlet which can be controllably positioned proximal to material to be gathered, such as pre-existing unconsolidated sediment, cuttings of the seafloor auxiliary mining tool and/or cuttings of the seafloor bulk mining tool. Thereby, suction at the slurry inlet causes water and proximal solids to be drawn into the inlet in the form of a slurry. The seafloor gathering tool preferably has a remote attachment and disconnection system for connection of a riser transfer pipe for transfer of the slurry to the riser base. In such embodiments, the remote connection system enables deployment and recovery of the gathering machine to and from the seafloor without recovery of the slurry riser system. The suction at the slurry inlet may be generated by a pump of the gathering tool, or alternatively may be generated by a subsea transfer pump at the riser base.

The bench may comprise an ore bench of valuable ore to be retrieved, or may comprise a bench of hard rock, consolidated or unconsolidated material, or other seafloor material to be removed for other purposes. The ore may comprise seafloor massive sulphides.

The riser and lift system preferably comprises a subsea slurry lift pump to pump slurry to the surface through a riser pipe.

The surface vessel may be a navigable vessel, a platform, a barge, or other surface hardware. The surface vessel preferably comprises dewatering equipment to dewater the slurry received from the riser, and may further comprise ore transfer and/or processing facilities such as an ore concentrator.

BRIEF DESCRIPTION OF THE DRAWINGS

An example of the invention will now be described with reference to the accompanying drawings, in which:

FIG. 3 generally illustrates temporal progression of mining at two nearby seafloor sites in accordance with the embodiment of FIG. 1;

DESCRIPTION OF THE PREFERRED EMBODIMENTS

The following abbreviations and acronyms are used throughout the following detailed description:

| | |
|---|---|
| m | Meters |
| PSV | Production Support Vessel |
| RALS | Riser and Lifting System |
| ROV(s) | Remotely Operated Vehicle(s) |
| RTP | Riser Transfer Pipe |
| SMS | Seafloor Massive Sulphide |
| SMT(s) | Seafloor Mining Tool(s) |
| SSLP | Subsea Slurry Lift Pump |
| GM | seafloor Gathering and cutting Machine |
| AUX | seafloor Auxiliary Mining machine |
| BM | seafloor Bulk Mining machine |

Figure 1:
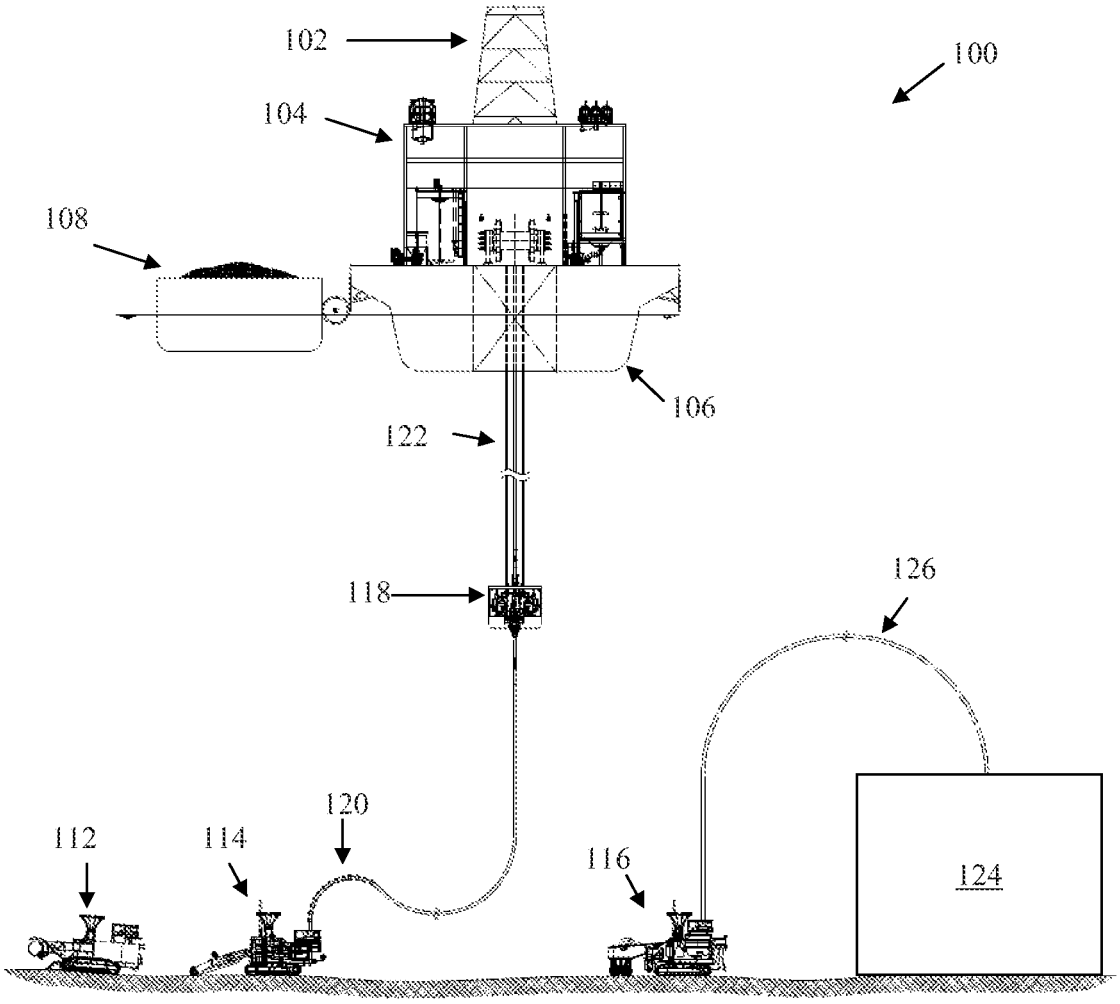
FIG. 1 is a simplified overview of a subsea system in accordance with one embodiment of the present invention.

FIG. 1 is a simplified overview of a subsea system 100 in accordance with one embodiment of the present invention. A derrick 102 and dewatering plant 104 are mounted upon an ocean going production support vessel 106. PSV 106 has ore transfer facilities to load retrieved ore onto barge 108. The present embodiment provides a system 100 operable to 2500 m depth, however alternative embodiments may be designed for operation to 3000 m depth or greater. During production operations, seafloor mining tools (SMTs) will be used to excavate ore from the seabed 110. The SMTs comprise a seafloor bulk mining machine 112, a seafloor gathering machine 114 and a seafloor auxiliary mining machine 116.

Mined ore is gathered and pumped, in the form of slurry, through a riser transfer pipe (RTP 120) to the base of the riser 122. A subsea lift pump 118 then lifts the slurry via a rigid riser 122 (shown interrupted in FIG. 1, and may be up to 2500 m long in this embodiment). The slurry travels to the surface support vessel 106 where it is dewatered by plant 104. The waste water is returned under pressure back to the seafloor to provide charge pressure for the subsea lift pump 118. The dewatered ore is offloaded onto transport barge 108 to be transported to a stockpile facility before being transported to a processing site.

Figure 2:
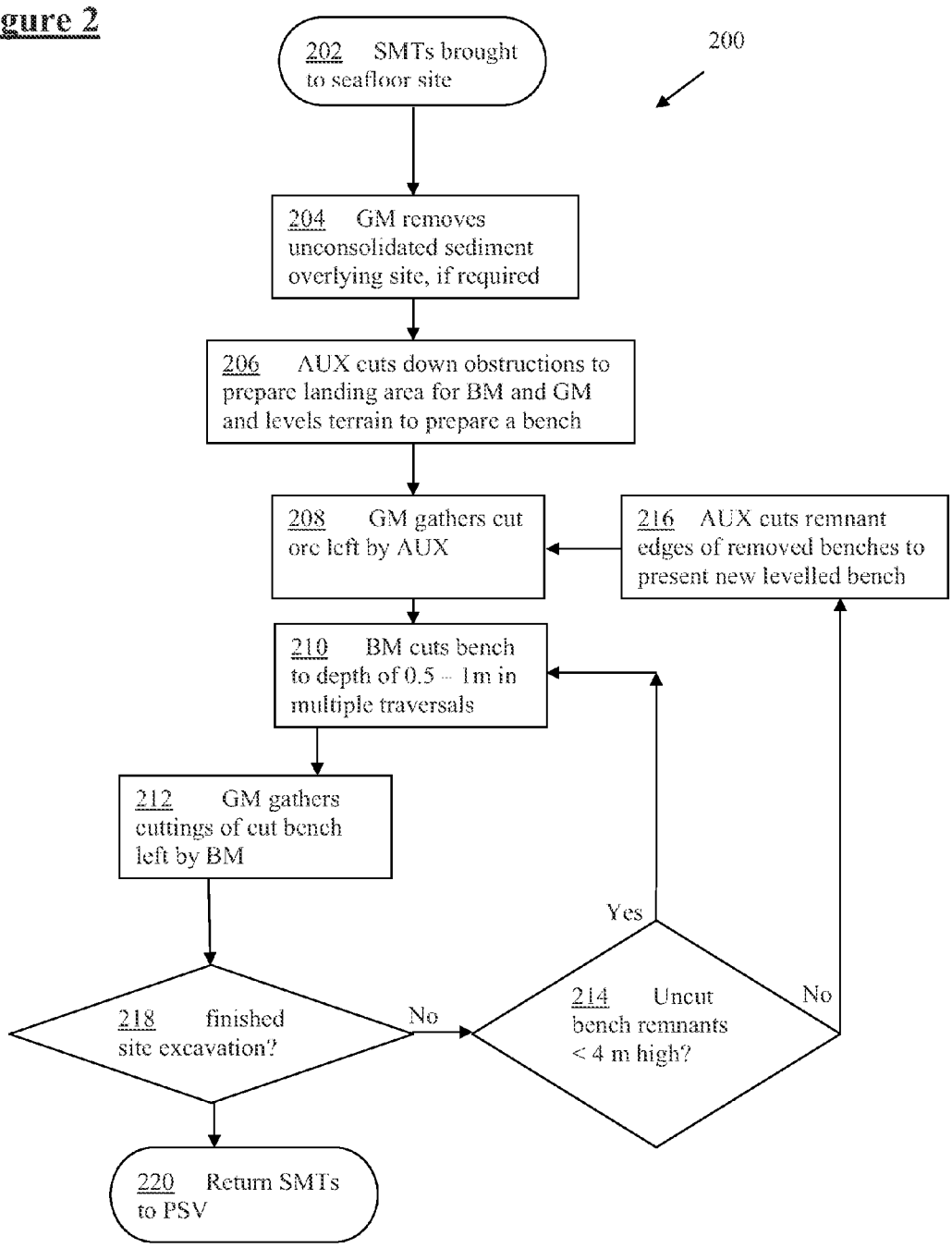
FIG. 2 is a flowchart illustrating seafloor operations of the system of FIG. 1.

FIG. 2 is a flowchart illustrating in more detail the seafloor operations of the SMTs 112, 114, 116. The process 200 commences at 202 with the SMTs 112, 114, 116 descending from PSV 106 to the seafloor site, and RALS 122 being deployed. SMTs 112, 114, 116 are each launched from the PSV 106 via an articulated A-frame and deployment winch, configured to pick up the respective SMT and launch it over the side of the PSV 106, to be lowered to the seafloor by the deployment winch. At 204, unconsolidated sediment overlying the site is removed as a slurry by a suction pipe of GM 114, and deposited in a pre-defined area down-slope and down-current that does not form part of the mine.

Figure 6A:
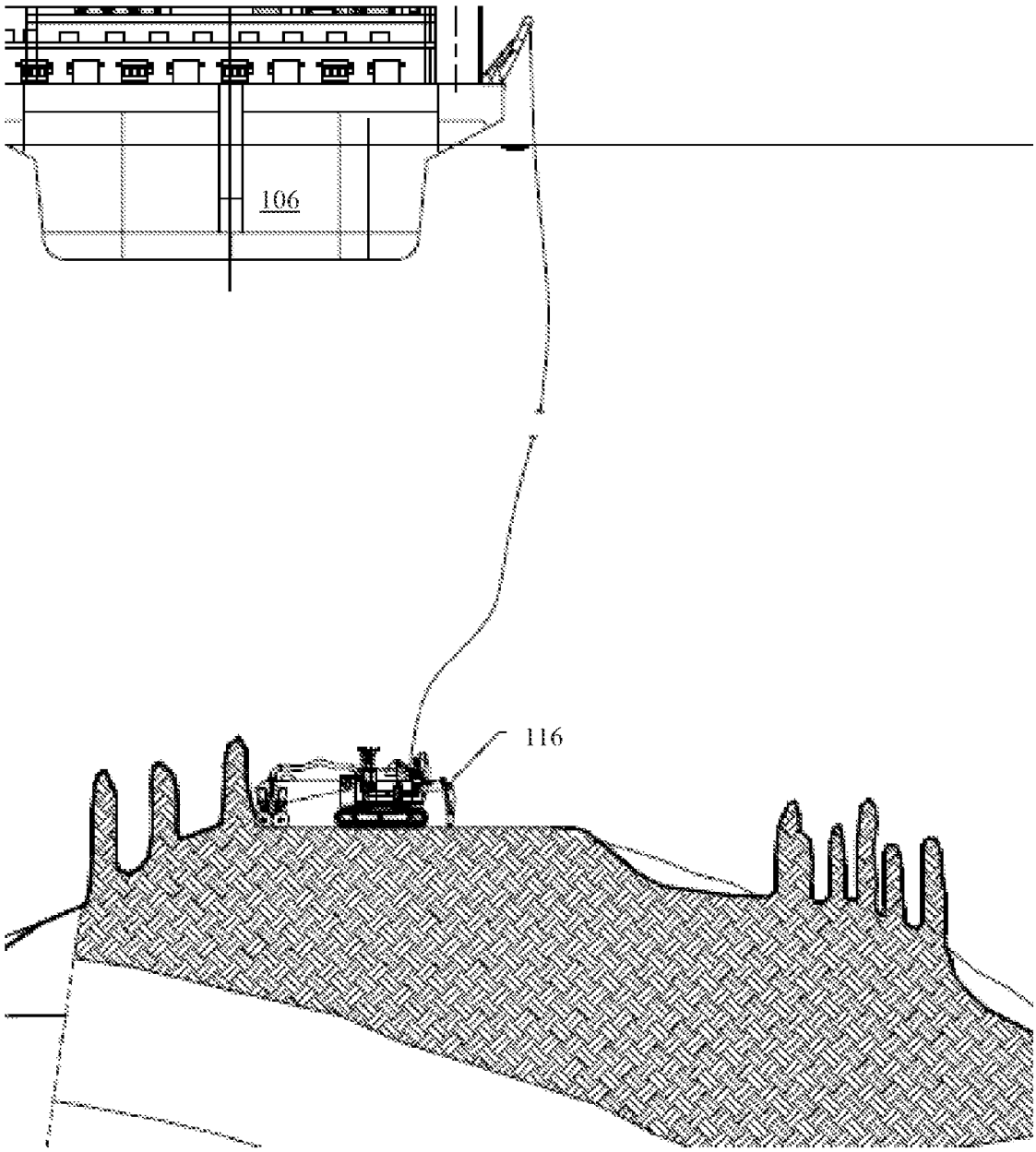
FIGS. 6*a* to 6*e* illustrate a seafloor mining environment at selected mining stages during operation of the system of the present embodiment.

At 206, pre-existing obstructions presented by the potentially complex and irregular seafloor topography are cut down by the AUX 116 in order to prepare a landing, cutting and gathering area for the BM 112 and GM 114. FIG. 6*a* illustrates the seafloor mining environment during stage 206. In complex and very irregular seafloor topographies step 206 may occur before step 204. The AUX 116 may also need to prepare a site for a stockpile 124.

Figure 6B:
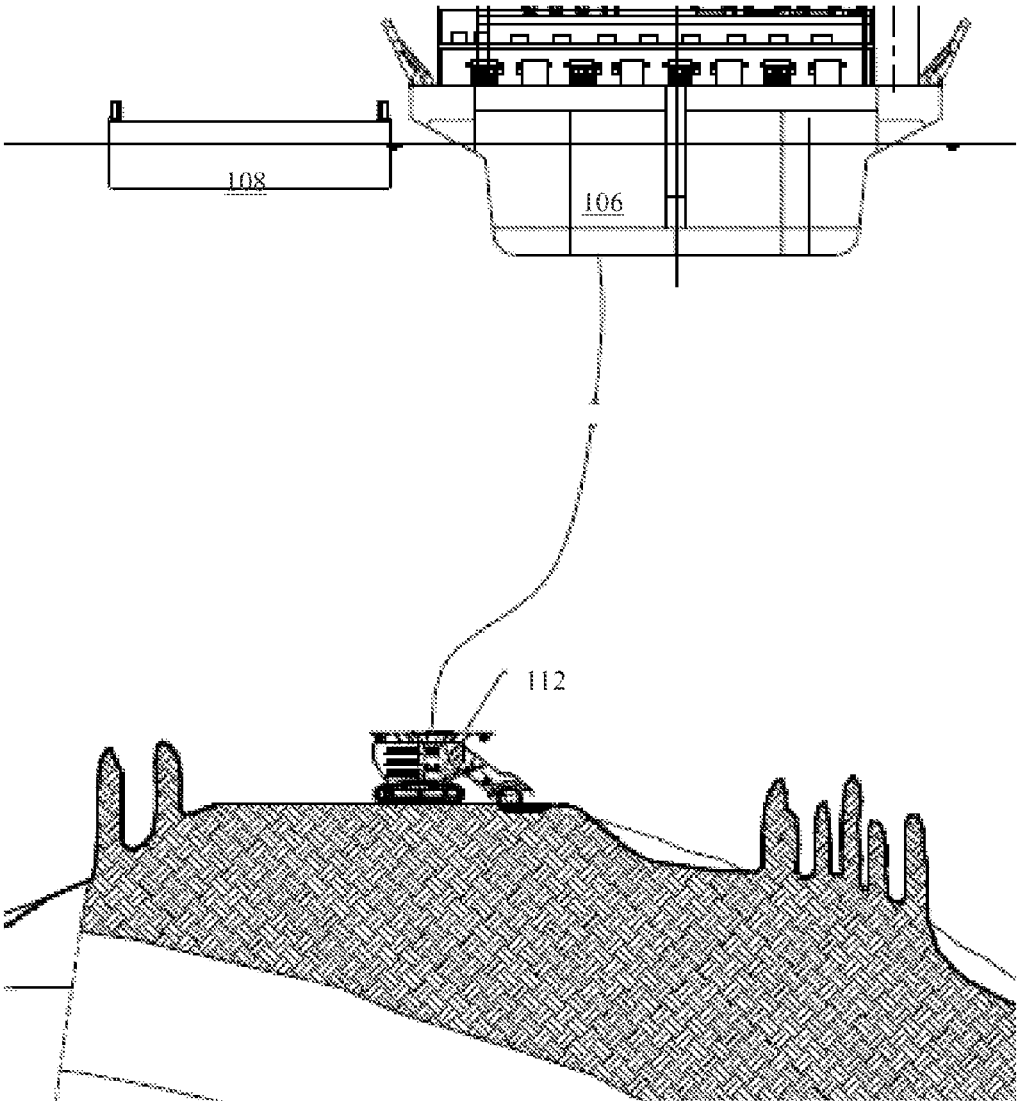

At 208, the GM 114 gathers the cuttings produced by AUX at step 206, whether from the bench or a stockpile, leaving a cleared bench ready for the BM 112. At 210, the BM 112 cuts the bench to a selected cutting depth, typically being in the range of 0.5 m to 1 m, depending on rock hardness for example. If the BM is in a plunge cutting mode the bench cut depth will be up to 4 m. The BM 112 cuts the bench while progressing across the bench, and makes one or more traversals back and forth across the bench in order to cut substantially the entire area of the bench. The BM 112 may further make additional passes roughly perpendicular to the original traversals in order to more closely trim the edges of the bench. FIG. 6*b* illustrates the seafloor mining environment during stage 210. The BM 112 may leave cuttings on the bench or capture its own cuttings and pump them as a slurry to a stockpile location via stockpile hose 126 and stockpile system 124. In the case of distal stockpiling the BM 112 can cut the bench in multiple passes, each of say half a meter depth, up to about 4 m deep. This increases machine utilisation on the bench as the bulk miner 112 need not vacate the bench after each 0.5 m deep pass to permit access by the gathering machine 114. Instead, the gathering machine 114 can gather cuttings from the stockpile location contemporaneously with the bulk miner 112 working the bench.

Figure 6C:
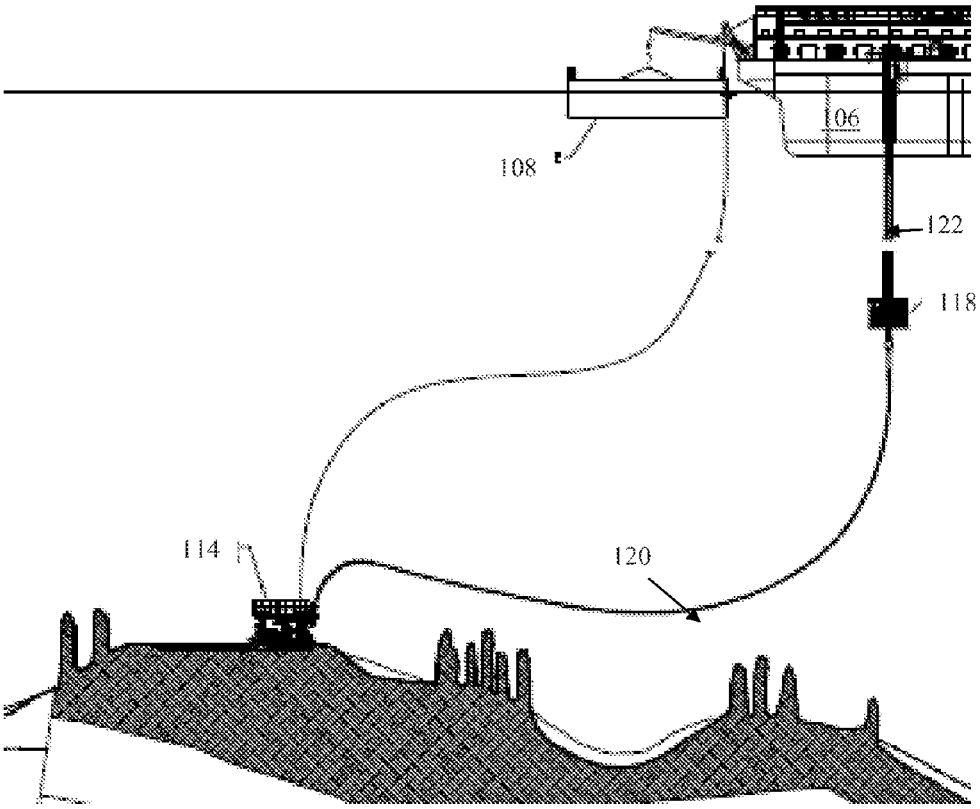

Once the BM 112 has completed cutting the bench at 210, at 212 the GM moves onto the bench and gathers cuttings of the bench left by the BM 112. FIG. 6*c* illustrates the seafloor mining environment during stage 212.

Figure 6D:
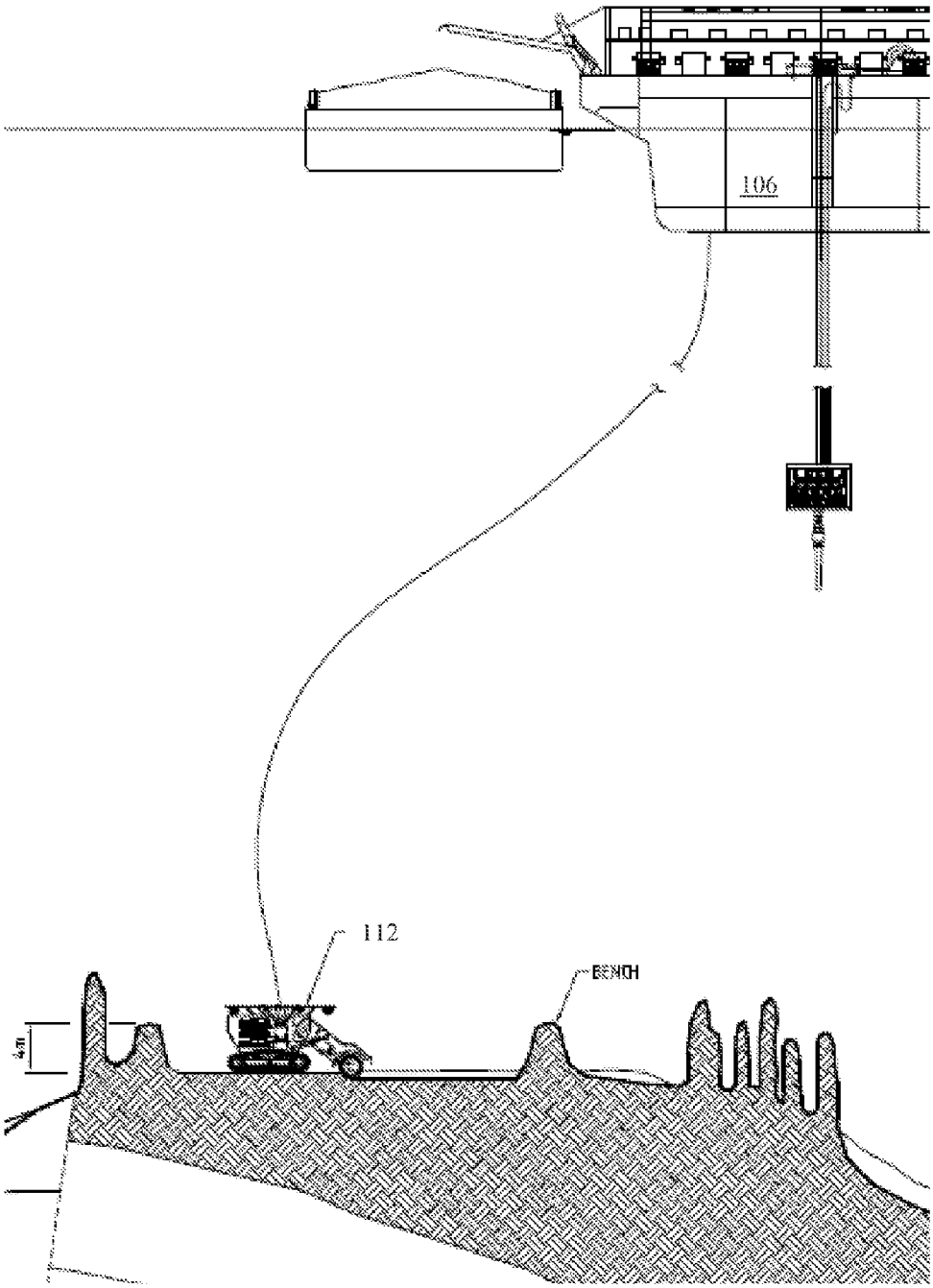

Given the bulk mining role of the BM 112 it is expected that some portion of the bench, particularly at lateral extremities and footwalls where the BM 112 must maintain a safety margin as well as have room to turn around to begin a new traversal of the bench, will not be fully cut by the BM. These remnant edges can be left in place while multiple layers of benches are removed, until the remnant edges become large enough to require removal. Thus, at 214 the process returns to 210 if the remnant edges are less than 4 m high. This is shown in FIG. 6*d*, in which the bench edges are about 4 m high.

Figure 6E:
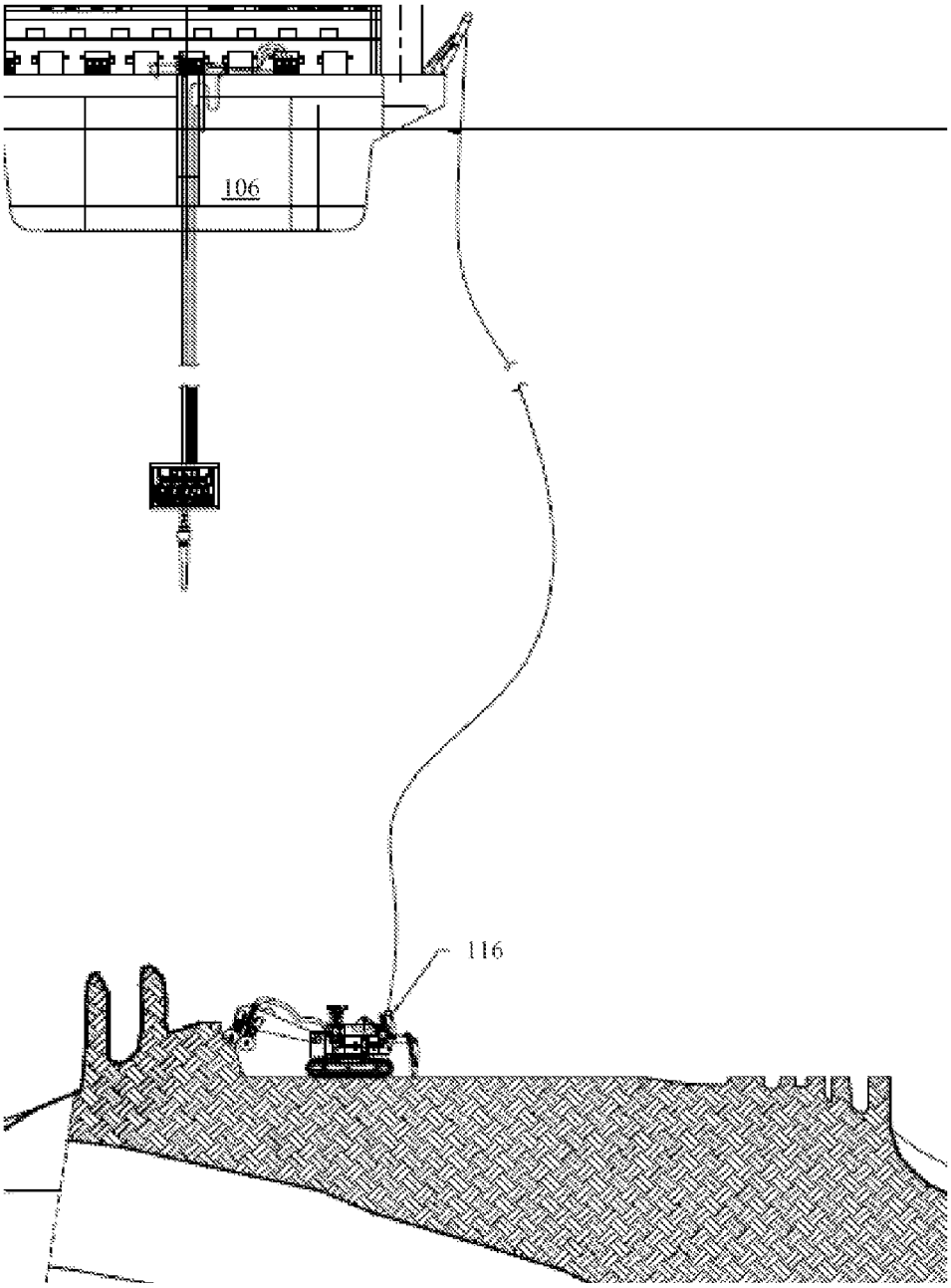

Once the remnant edges become about 4 m high, being the maximum working height of the AUX 116 in this embodiment, then at 216 the process instead calls for the AUX 116 to cut away the remnant edges so that the entire bench presented is once again suitably flat for the BM 112. FIG. 6*e* illustrates the seafloor mining environment during stage 216.

Once the ore deposit is exhausted or mining is otherwise deemed complete at 218, the SMTs 112, 114, 116 are returned to the PSV 106 at 220.

The mining process and system 100 thus provides for seafloor mining tools, a riser and lifting system (RALS) 118, 122, production support vessel (PSV) 106 with dewatering facilities 104, ore transportation to and subsequent storage at an onshore stockpile facility, load-out and transportation to a processing facility, concentration of ore product, and load-out and transportation of concentrate to market.

The seafloor mining tools 112, 114, 116 are designed to manoeuvre around the mine site and to cut mineral deposits through remote operator control on the topside Production Support Vessel 106. Due to the typically irregular topography of such sites, the system is designed for operation over uneven ground and slopes of up to 20 degrees. The SMTs 112, 114, 116 manoeuvre around the mine site and negotiate the rough terrain, steeper slopes and steps. Notably, avoidance of umbilical entanglement is a significant issue and the PSV 106 may relocate and/or change bearing during seafloor tool movement to ensure no entanglement arises.

The seafloor mining tools 112, 114, 116 comprise three separate machine types. The seafloor mining tools are remote operated vehicles, capable of operating to a water depth of 2500 m, which are operated and co-ordinated from dedicated controls on board the PSV 106. The SMTs excavate ore bearing material from the seafloor. The three machines in combination cut, size gather and excavate ore from the seafloor 110.

Overall, the seafloor mining equipment is operated as two interdependent functions, being ore cutting on one hand, and gathering and pumping on the other hand. Broken floor stocks and/or stockpiling provide a buffer between the two functions. Control systems on board the PSV 106 ensure efficient optimisation of SMT operations whilst maximising a safe working area between machines, umbilicals and lift wires to ensure ongoing and efficient seafloor excavation operations.

The cutting machines are the auxiliary mining machine (AUX) 116, and the Bulk mining machine (BM) 112. In some embodiments the gathering machine may also be configured to undertake some cutting as necessary to aid the gathering function. Co-ordination of the machines is subject to a seafloor mine plan based on in-situ ore grade, seafloor topography and operational and maintenance constraints.

As illustrated in FIG. 3, the machines are sequenced to maximize value from production. Typically, each seafloor site will be a high point in the seafloor terrain, with the AUX 116 being landed at or near the high point, and creating its own ramp up to the high point if necessary. At the high point the AUX 116 prepares a landing area and initial bench for the BM. In this embodiment the BM 112 requires a minimum bench area of around 750 square meters for efficient BM operation. In alternative embodiments the dimensions of the BM may be of a smaller scale to permit the BM to commence operations upon a bench of area less than 750 square meters, or in other embodiments the BM may be of a larger scale and require a minimum bench size of greater than 750 square meters to commence operation. Benches are then progressively removed from the high point so as to recover the mound of ore deposit.

For more sharply defined ore mounds with more acute high points, the AUX 116 is employed to excavate multiple layers of benches until the bench area grows to around 750 square meters or more. Due to the boom mounted cutting head of the AUX 116, the bench height cut by the AUX 116 in this embodiment is around 4 meters.

Excavated particle size is controlled by the AUX/BM cutter type and speed of advancement, and in some embodiments also is controlled by the GM 114. This is determined by cutter pick spacing, angle, speed of cutter rotation and rate of machine advancement. Cutting system parameters (cutter rotation speed, cut depth, advancement speed) can be manually or automatically controlled. In some embodiments, interlocking may be provided as a safety measure to prevent stalling of cutting operations and potential damage to the machines. In alternative embodiments particle size may be controlled by a seafloor crusher or sizing device, which may be separate to or integrated with the BM.

Additional digging lines for the BM 112 and vehicle manoeuvring turns can be undertaken manually or by means of automated routines. Automation of the cutting is preferably maximised, and to this end a control system of the PSV 106 has the capability to incorporate automatic feedback control integrated into a mine model such that operating parameters such as cutting rate, recovered ore grade, rock hardness and particle size learned from overlying benches coupled with survey scans of the material below can be automatically used to control mining of subsequent underlying benches.

Overall, the aim of the cutting sequence is to maximise production rate and deliver stockpiles of cut ore on the seafloor for subsequent feed into the gathering machine.

Once cut, the ore must then be gathered. In some systems, ore gathering can be a limit or bottleneck to the production rate of the overall system, however by providing a separate gathering machine 114, which in some embodiments can be both a cutting and gathering machine, application of the present invention to such embodiments can provide for gathering to not be a limit to the production rate of the overall system 100. This is due to the gathering machine 114 being engineered such that it is required to be operational only part of the time. The gathering machine is intermittently operated to minimise unproductive downtime of the cutting machines associated with simultaneous operations. Coordination of the machines is subject to a seafloor mine plan based on in-situ ore grade, seafloor topography and operational and maintenance constraints. In some systems, production rate can be predominantly driven by the cutting machines, and some embodiments of the invention may accordingly provide for the gathering machine to be operational only part of the time in such systems. Gathering machine parameters (flow rate/GM advancement speed/auger speed/suction head control) are controlled and/or set by operators on the PSV 106.

An inlet grizzly sizing screen is used on the GM 114 inlet to prevent over-size particles being introduced into the slurry system 120, 118, 122, 104. The system 100 is designed so that this grizzly screen size is interchangeable.

The gathering machine 114, and in some embodiments also the BM 112 and the AM 116, has a pump and control system which maintains the integrity of slurry flow and accounts for anticipated variability in inlet slurry conditions. The pump/gathering system incorporates automatic slurry inlet dilution and bypass valves to prevent loss of flow integrity associated with blockages and/or instantaneous changes in slurry intake density outside of the system's specified operating limits. Alternative slurry density control systems may be employed in other embodiments.

In order to minimise risk of blocking the RTP 122 and/or GM 114, in this embodiment the GM 114 has a dump valve that is activated when the slurry flow integrity is compromised. In alternative embodiments of the invention a dump valve may be omitted. The GM 114 of this embodiment further incorporates a back flow system to assist in clearing any slurry system blockages within the GM 114. This system is a configuration of pipes and valves that direct high pressure water from the slurry discharge line back to the suction head of the gathering machine 114. In embodiments where the stockpile hose 126 and stockpile system 124 are provided, dump valves and/or backflow systems may similarly be provided.

Figure 4:
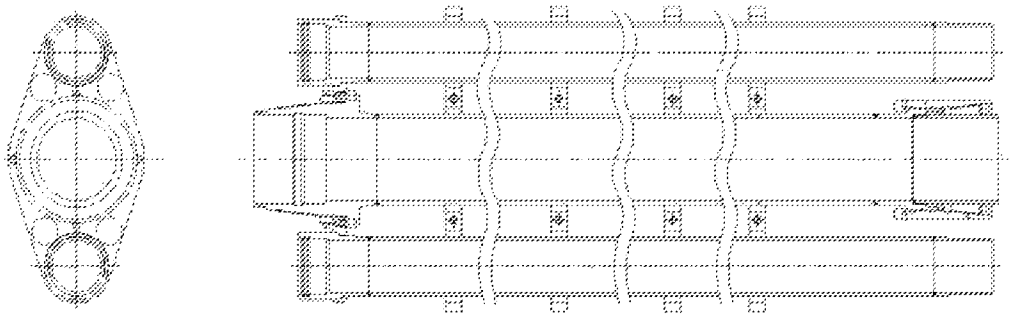
FIG. 4 illustrates a suitable riser joint and connector arrangement for use in the system of the embodiment of FIG. 1.

FIG. 4 illustrates a suitable riser joint and connector arrangement for use in the system of the embodiment of FIG. 1. The Riser and Lift System (RALS) lifts the seawater-based slurry containing the mineral ore particles to the Production Support Vessel (PSV) 106 at the surface via a vertical steel riser 122 suspended from the vessel. The ore particles mined by the SMT are collected using suction, and the particles thus become entrained in seawater-based slurry which is then pumped to the base of the riser via a Riser Transfer Pipe (RTP) 120. A Subsea Slurry Lift Pump (SSLP) 118 suspended below the base of the riser 122 will drive the slurry from the base of the riser 122 to the vessel 106, which will be over a height of up to 2500 m in this embodiment. Once at the surface, the slurry passes through a dewatering process 104. The solids are transferred to a transport barge 108 for shipment to shore. The waste water, topped up with additional seawater as required, is passed through a header tank system onboard the PSV 106 and pumped back down to the base of the riser 122 via auxiliary seawater pipelines clamped to the main riser pipe 122. The return seawater, on arrival at the base of the riser 122, is then used to drive the positive-displacement chambers of the SSLP 118 prior to being discharged into the sea close to the depth at which it was originally collected. Alternative means to drive the SSLP 118 can also be provided, for example electric, hydraulic, pneumatic or electro-hydraulic systems, among others.

As shown in FIG. 4, the riser 122 is supplied in sections (joints), each joint being made up of a central pipe for the transportation of slurry mix from the base of the riser to the surface, together with two water return lines for powering the Subsea Slurry Lift Pump 118 from the surface. Plus, a Dump Valve System to enable all slurry in the Riser pipe 122 to be flushed from the system in the event of unexpected shut down, to prevent blockages.

The Subsea Slurry Lift Pump (SSLP) 118 is suspended at the bottom of the riser 122 and receives slurry from the seafloor mining tools 114 via the riser transfer pipe 120. The SSLP 118 subsequently pumps the slurry to the Production Support Vessel 106. The pump assembly 118 comprises two pump modules, each module containing a suitable number of positive displacement pump chambers driven by pressurised water delivered from surface pumps via seawater lines attached to the riser 122. The pump 118 is controlled from the surface vessel 106 by a computerised electronic system which passes control signals through umbilical cables to a receiving control unit on the pump 118. Functions are operated hydraulically with a bank of dual redundancy electro-hydraulic power packs located on the pump 118. The electrical power to drive the power packs is fed through the same umbilical cables which carry the control data signals from the surface to the pump 118. The two (dual redundancy) umbilicals for control of the SSLP 118 are secured to clamps on the riser 122 with the weight of the umbilical distributed along the riser joints.

The main function of the surface pumps is to provide pressurized water to drive the Subsea Slurry Lift Pump 118. Multiple triplex or centrifugal pumps will be installed on the Production Support Vessel 106, all taking water removed from the slurry mix (<0.1 mm residues) in the dewatering process, made up with surface seawater to the required volume before being pumped down the water return lines to the SSLP 118 at depth. The surface system incorporates a return water header tank fed from the dewatering system and topped up with the required volume to drive the SSLP 118 using centrifugal pumps extracting filtered surface seawater via a sea chest in the vessel hull. The water in the header tank is delivered to a bank of charge pumps which boost the pressure for delivery to the inlet of the surface pumps.

A derrick and draw-works system 102 is installed on the support vessel 106 in order to deploy and recover the riser 122 and subsea lift pump 118. In addition, handling systems within the area of the derrick 102 move the SSLP 118 into a designated maintenance area.

A surge tank is incorporated between the RALS discharge and the dewatering plant 104 to moderate instantaneous slurry variability prior to feed into the dewatering plant. In an alternative embodiment the vibrating screens in FIG. 5 act as a surge tank and a surge tank for fines under flow is placed between the double deck screening and the hydrocyclone bank of FIG. 5.

Figure 5:
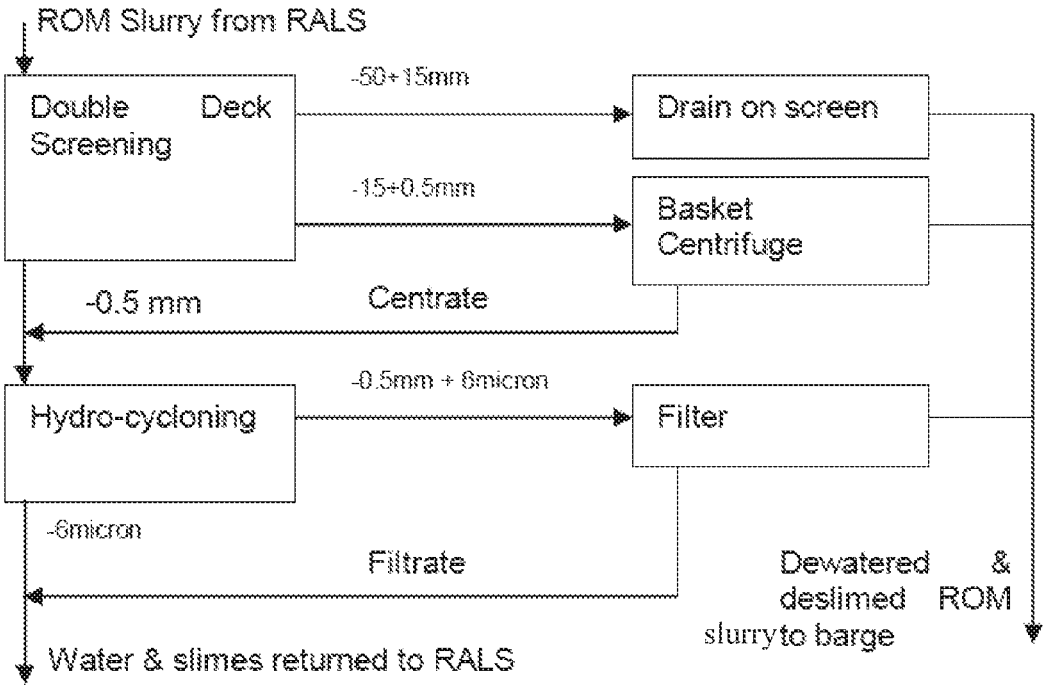
FIG. 5 is a block diagram illustrating a dewatering plant process suitable for use in the embodiment of FIG. 1.

The dewatering system 104 will receive ore from the RALS 122 as mineral slurry. To ensure that the ore is suitable for transport, the large volume of water within the slurry must be removed. As shown in FIG. 5, the dewatering process of this embodiment uses three stages of solid/liquid separation:

Stage 1—Screening—using vibrating double deck screens

Stage 2—De-sanding—using hydro cyclones and centrifuges

Stage 3—Filtration—using filters

Vibrating screen decks are used to separate the coarse particles from the slurry stream. These coarse particles are considered to be free draining and will not require any mechanical dewatering to achieve the required moisture limit. A vibrating basket centrifuge is used to provide mechanical dewatering of the medium particle size fraction to ensure the required moisture limit is reached.

Hydro cyclones are then used to separate the valuable fine particles (>0.006 mm) from the slurry feed which have not been removed by the screen decks. Filters are used to dewater the valuable fines (between 0.5 mm and 0.006 mm) prior to loading on to the transport barge 108. This ore size fraction requires greater mechanical input (vacuum) to remove moisture. The ore/slurry waste water is then returned to the seafloor via a pump-set and piping system. A dewatering plant 104 is installed on the topsides surface facilities, in this case the PSV 106, to reduce the moisture content of the ore to below the transportable moisture limit (TML) of the ore. Reducing the moisture content below the TML allows safe carriage of the ore by ship. It also reduces the cost of transport due to the reduced volume of material being shipped. Alternative embodiments may utilise any suitable other configuration of dewatering plant.

In the case of dewatering plant 104 failure, the gathering machine 114 will disengage the seafloor 110 and continue pumping seawater. The volume of the surge tank is sufficient to accommodate the volume of slurry in the RALS 122, 118 in the case of any dewatering plant 104 failure. The slurry in the RALS 118, 122 will be discharged to the surge tank, or vibrating screens and surge tank, until seawater only is discharged to surface, at which time the dewatering plant 104 by-pass will be engaged and water circulated back to the subsea lift pump or the RALS/gathering machine shut down.

The PSV 106 remains on location for the duration of mining and supports all mining, processing and offshore loading activities to enable safe and efficient mining of the seafloor deposits 110, recovery of cut ore to the surface, treatment (dewatering, including return of treated water to seafloor) and off-loading of the dewatered ore into the transportation barges 108 for onward shipment to stockpiling and subsequent treatment facilities. Station holding capability for the vessel is via dynamic positioning. Alternative station holding may be by mooring the vessel, or by a combination of both dynamic positioning and mooring depending on site specific conditions.

The system 100 of the present embodiment thus provides a means and method for achieving steady state seafloor mining and gathering production, such as seafloor massive sulphide (SMS) production.

It is to be appreciated that particular terms used herein may be synonymous with other terms which equally describe the present invention, and the scope of the present application is thus not to be limited to any one such synonym. For example, seafloor mining tools may also be referred to as subsea machines, a production support vessel may be referred to as a surface vessel and/or surface facilities, ore may be equally or alternatively referred to as rock, consolidated sediment, unconsolidated sediment, soil, seafloor material, and mining may comprise cutting, dredging or otherwise removing material. Moreover, particular values provided give an illustration of scale in the described embodiments but are not to be considered restrictive as to the scale or range of values which might be used in other embodiments to suit the environment of application.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A system for seafloor mining, the system comprising:

a seafloor auxiliary mining tool for working a seafloor site to prepare a bench, and for deposition cut ore in a gathering area;

a seafloor bulk mining tool for production cutting of the bench and deposition of cut ore in the gathering area;

a seafloor gathering machine for gathering cut ore deposited in the gathering area and pumping gathered ore as a slurry to a riser base;

a riser and lifting system for receiving the slurry from the gathering machine and lifting the slurry to a surface; and a surface vessel for receiving the slurry from the riser and lifting system.

2. The system as claimed in claim 1, wherein the seafloor auxiliary mining tool is configured to clear the seafloor auxiliary mining tool cuttings to a dump site to enable the seafloor auxiliary mining tool to progress through a formation as the seafloor auxiliary mining tool works.

3. The system as claimed in claim 1, wherein the seafloor bulk mining tool is configured to work on a relatively flat and relatively horizontal bench surface and to cut into the surface to a cutting depth while traversing across the bench surface, such that the seafloor bulk mining tool cuts substantially the entire bench by traversing the surface of the bench in one or more paths.

4. The system as claimed in claim 1, wherein the seafloor bulk mining tool is configured to leave cuttings in place for subsequent gathering by the seafloor gathering machine.

5. The system as claimed in claim 1 wherein the seafloor gathering machine comprises a mobile slurry inlet which can be controllably positioned proximal to material to be gathered, whereby suction at the slurry inlet causes the slurry in the form of water and proximal solids to be drawn into the mobile slurry inlet.

6. The system as claimed in claim 1 wherein the seafloor gathering machine has a remote attachment and disconnection system for connection of a riser transfer pipe for transfer of the slurry to the riser base.

7. The system as claimed in claim 5 wherein suction at the slurry inlet is generated by a pump of the seafloor gathering machine.

8. The system as claimed in claim 5, wherein suction at the slurry inlet is generated by a subsea transfer pump at the riser base.

9. The system as claimed in claim 1 wherein the riser and lifting system comprises a subsea slurry lift pump to pump the slurry to the surface through a riser pipe.

10. The system as claimed in claim 1, further comprising a seafloor stockpiling device for retaining cut ore, to which cuttings of at least one of the seafloor auxiliary mining tool and seafloor bulk mining tool are pumped in slurry form, and from which the gathering machine gathers cut ore.

11. The system as claimed in claim 1, wherein the seafloor auxiliary mining tool is capable of traversing uneven ground and slopes, at an angle up to 10 degrees.

12. The system as claimed in claim 11, wherein the seafloor auxiliary mining tool is capable of traversing uneven ground and slopes, at an angle up to 20 degrees.

13. The system as claimed in claim 12, wherein the seafloor auxiliary mining tool is capable of traversing uneven ground and slopes, at an angle up to 25 degrees.

14. The system as claimed in claim 1, wherein the system is operable at a depth greater than 400 m.

15. The system as claimed in claim 14, wherein the system is operable at a depth greater than 1000 m.

16. The system as claimed in claim 15, wherein the system is operable at a depth greater than 1500 m.

17. A method for seafloor mining, the method comprising:

preparing a bench of a seafloor site using a seafloor auxiliary mining tool;

bulk mining the bench with a seafloor bulk mining tool and depositing cut ore in a gathering area;

gathering cut ore from the gathering area using a seafloor gathering machine, and pumping gathered ore as a slurry from the seafloor gathering machine to a riser base; and lifting the slurry to a surface vessel using a riser and lifting system.

18. The method as claimed in claim 17, wherein the seafloor auxiliary mining tool deposits cut ore in the gathering area for gathering by the seafloor gathering machine.

19. The method as claimed in claim 17, wherein the material to be retrieved is of a thickness greater than a bench height, the bench height being defined by a cutting depth of the seafloor bulk mining tool, the method further comprising removing multiple bench layers of the material to be retrieved by sequential bulk mining and gathering steps.

20. The method as claimed in claim 19, wherein the seafloor auxiliary mining tool is used to prepare and trim each of the multiple bench layers.

21. The method as claimed in claim 19, wherein the seafloor auxiliary mining tool is used to prepare and trim only some of the multiple bench layers.

22. The method as claimed in claim 17, wherein the seafloor gathering machine is utilised to remove sediment overlying a seafloor deposit of interest, prior to deployment of the seafloor auxiliary mining tool and the seafloor bulk mining tool to that deposit.

23. The method as claimed in claim 17, wherein when deployed to seafloor sites of complex topography, the seafloor auxiliary mining tool is employed to initiate site excavation by preparing a landing area for the seafloor bulk mining tool, or excavating extremities of the site in order to prepare a first bench ready for the seafloor bulk mining tool.

24. The method as claimed in claim 17, wherein after the seafloor bulk mining tool has cut one or more benches, and the seafloor gathering machine has gathered cuttings to clear the one or more benches, the seafloor auxiliary mining tool is employed to excavate remnant bench extremities or edge sections inaccessible to or bypassed by the seafloor bulk mining tool.

25. The method as claimed in claim 17, wherein during a time period in which the seafloor bulk mining tool works the bench, the seafloor auxiliary mining tool and the seafloor gathering machine are kept at a distance from the bench to avoid tool interference, and to avoid umbilical entanglement in the case of tethered vehicles.

26. The method as claimed in claim 25, wherein during the time period in which the seafloor bulk mining tool works the bench, the seafloor auxiliary mining tool and seafloor gathering machine are employed in respective tasks on one or more separate benches within range nearby, to provide for work on multiple bench sites to be progressed simultaneously, increasing tool utilisation.

* * * * *